United States Patent [19]

Hall

[11] Patent Number: 4,624,644

[45] Date of Patent: Nov. 25, 1986

[54] STOP DEVICE FOR OUTBOARD ENGINE PROPELLERS

[76] Inventor: William E. Hall, 12809 Oakmont, Kansas City, Mo. 64145

[21] Appl. No.: 678,292

[22] Filed: Dec. 5, 1984

[51] Int. Cl.[4] ..... B63H 1/14

[52] U.S. Cl. ..... 440/49; 440/74; 440/113; 29/426.5; 29/240

[58] Field of Search ..... 440/49, 71, 74, 113; 114/172; 70/57, 58, 226; 416/146, 62; 188/69; 248/640–643; 29/426.5, 240, 267, 283

[56] References Cited

U.S. PATENT DOCUMENTS

| | | | |
|---|---|---|---|
| 1,125,860 | 1/1915 | McGee | 188/69 X |
| 2,402,197 | 6/1946 | Kincannon | 440/49 X |
| 2,486,672 | 11/1949 | Notestein et al. | 416/146 |
| 2,966,319 | 12/1960 | Todish et al. | 248/640 |
| 4,564,991 | 1/1986 | Taylor | 29/426.5 |

*Primary Examiner*—Sherman D. Basinger
*Assistant Examiner*—Paul E. Salmon
*Attorney, Agent, or Firm*—Kokjer, Kircher, Bradley, Wharton, Bowman & Johnson

[57] ABSTRACT

A stop device for application to an outboard marine engine to retain the propeller against rotation while the prop nut is being tightened or loosened. The device is T-shaped and includes side wings and a vertical leg. The wings have slots which permit the device to be slipped onto a tail plate located above the propeller. The leg extends downwardly between the blades of the propeller and engages the blades to prevent propeller rotation.

14 Claims, 4 Drawing Figures

STOP DEVICE FOR OUTBOARD ENGINE PROPELLERS

BACKGROUND AND SUMMARY OF THE INVENTION

This invention relates generally to outboard marine engines and more particularly to a tool which facilitates tightening and loosening of the prop nut which holds the propeller on an outboard engine.

The servicing of outboard marine engines often involves removal and reinstallation of the propeller. Normally, the propeller is held on the drive shaft by a retainer nut which is commonly referred to as the prop nut. In order to tighten or loosen the prop nut, it is necessary to hold the propeller against rotation so that the prop nut can be turned without also turning the propeller. The usual practice involves gripping and holding one of the propeller blades in one hand while a wrench is applied to the prop nut and turned with the other hand. As can easily be appreciated, this practice can cause cuts and other damage to the hand which hold the propeller blade. It is also difficult to hold the propeller firmly enough to remove prop nuts that are securely tightened and to adequately tighten the prop nut in some instances.

So far as I am aware, there has not been available in the past any type of tool which serves to hold the propeller in place while the prop nut is being loosened or tightened. The primary goal of the present invention is to provide such a tool.

More specifically, it is an object of the invention to provide a propeller holding device which can be applied to an outboard engine propeller in a manner to hold the propeller against rotation so that the prop nut can be applied and removed.

Another object of the invention is to provide a device of the character described which is specially constructed to fit the fin structure which is located adjacent to the propeller of an outboard engine.

A further object of the invention is to provide a device of the character described which can be quickly and easily applied to and removed from the fin structure and which performs its intended function without damaging either the fin structure or the blades of the propeller.

An additional object of the invention is to provide a device of the character described which is simple and economical to construct and easy to use.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith and in which like reference numerals are used to indicate like parts in the various views.

Figure 1:
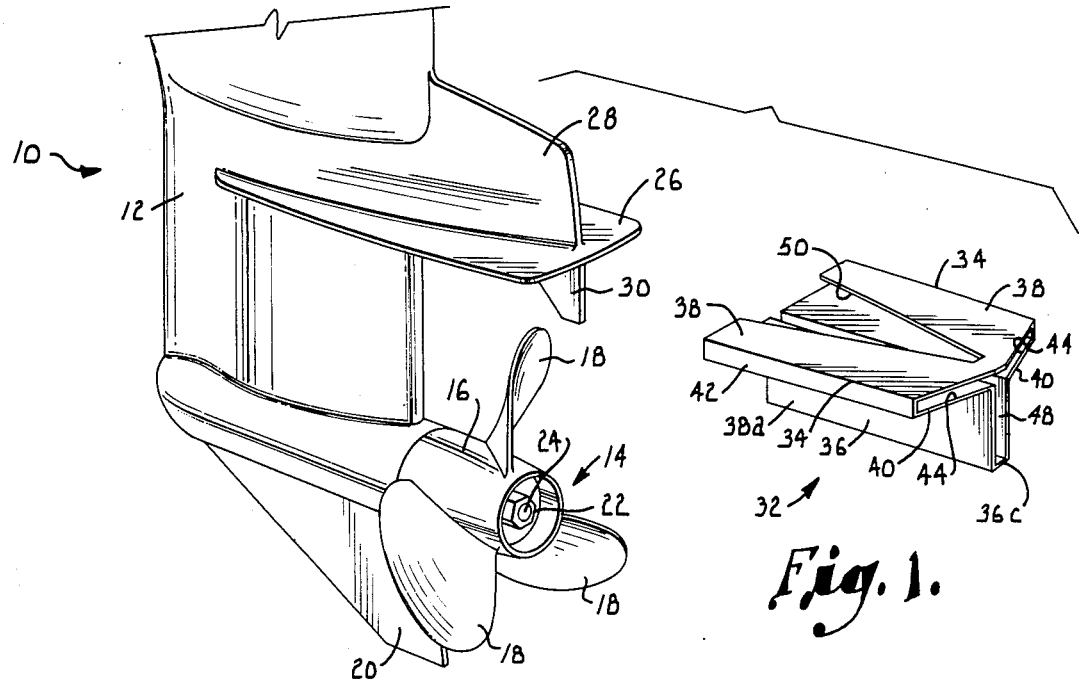
FIG. 1 is an exploded perspective view showing the lower submersible portion of an outboard marine engine and a propeller stop device constructed according to a preferred embodiment of the present invention.

Referring now to the drawing in more detail, a conventional outboard marine engine is shown fragmentarily in FIG. 1, and its submersible lower end portion is generally designated by numeral 10. The engine 10 is constructed in a well known manner and includes a housing having a generally vertical column 12 through which the drive line extends. The engine 10 includes a propeller 14 having a central hub 16 and three projecting blades 18. A rudder 20 is located at the bottom of the column 12. The propeller 14 is rotated by the drive line of the engine and is held in place on the column 12 by a prop nut 22 threaded onto a horizontal shaft 24 which extends through the hub 16. The prop nut 22 is normally hexagonal and may be removed from shaft 24 to permit the propeller 14 to be removed for servicing or replacement.

The column 12 is provided with a stabilizing fin structure which includes a horizontal tail plate 26 projecting rearwardly from the column 12 at a location above the propeller 14. A vertical fin 28 projects upwardly from the top surface of the tail plate 26 and is joined to the column 12. Fin 28 is tapered from front to back. Another vertical fin 30 essentially forms a downward continuation of fin 28 and projects from the underside of the tail plate 26. The engine may be mounted in the usual manner to the back of a bass boat or other boat, and the column 12 is submerged so that the propeller 14 can propel the boat when it is rotated by the engine.

In accordance with the present invention, the propeller 14 may be held against rotation by a stop device which is generally designated by reference numeral 32. The stop device has a T-shaped body which includes a pair of side wings 34 and a vertical leg 36. The device 32 is preferably formed in a single integral piece and may be constructed of a rigid plastic material or suitable metal.

Figure 2:
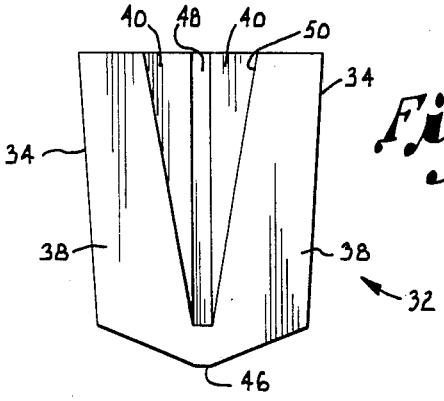
FIG. 2 is a top plan view of the propeller stop device shown in FIG. 1.

The wings 34 are located on the opposite sides of the device 32 and are flat members which are mirror images of one another. Each wing 34 includes flat top and bottom walls 38 and 40 which are parallel to one another and connected at their outer edges by an end wall 42. Each wing 34 is hollow and presents a uniform slot 44 between the top and bottom walls 38 and 40. The slots 40 are aligned with one another to provide a continuous slot which is substantially the same size as the tail plate 26 of the outboard engine. The wings 34 are each beveled on one end to form a nose 46, as best shown in FIG. 2. As also shown in FIG. 2, the side edges of the wings taper slightly from front to back so that tail plates of different widths can be accommodated.

The leg 36 extends downwardly from a location between the two wings 34. The leg includes opposite side walls **36*a* and 36*b* which are spaced apart and parallel to provide a slot 48 which is large enough to receive the small fin 30 projecting downwardly from the tail plate 26. Leg 36 has a bottom wall 36*c* which forms the bottom of the slot 48**.

A V-shaped notch 50 is formed in the top surface of the stop device 32 at a location between the wings 34. The notch 50 is formed in the top walls 38 of the wings and tapers gradually from front to back. The notch 50 terminates at a location near but offset from the nose 46.

Figure 3:
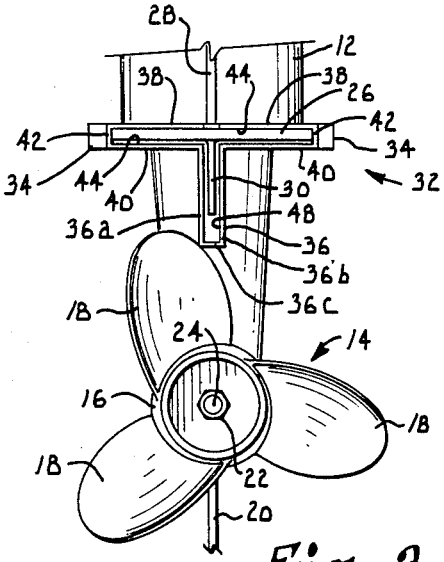
FIG. 3 is a rear elevational view showing the stop device applied to the engine and acting to hold the propeller against rotation during tightening of the prop nut.
Figure 4:
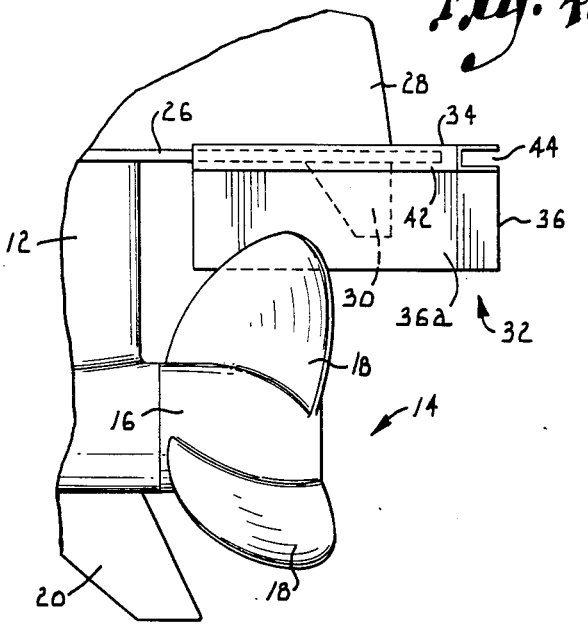
FIG. 4 is a side elevational view showing the stop device applied to the engine and acting to hold the propeller against rotation during tightening of the prop nut.

In use, the stop device 32 may be applied to the fin structure on column 12 to hold the propeller 14 against rotation so that the prop nut 22 can be loosened and tightened. The device is applied by slipping it onto the tail plate 26 such that the wings 34 receive the tail plate closely within the cooperating slots 44. When the slots 44 are properly aligned with the back edge of the tail plate 26, the device can simply be slid onto the tail plate. As the device is fitted on the fin structure, the V-shaped notch 50 accommodates the fin 28 on top of the tail plate, and the tapered configuration of the notch generally conforms with the tapered configuration of fin 28 so that the fin can fit in the notch. When the device 32 has been fully applied to the tail plate 26, it is in the position shown in FIGS. 3 and 4, and the lower fin 30 fits in the slot 48 formed in the leg 36 of the device.

The leg 36 is long enough to extend down from the tail plate 26 between adjacent blades 18 of the propeller. Consequently, one of the blades 18 engages side wall **36*a* of the leg 36 when the propeller is turned in a clockwise direction as viewed in FIG. 3. Once the blade 18 has moved into engagement with leg 36, further clockwise rotation of the propeller is prevented, and the prop nut 22 can be tightened on shaft 24 to the extent desired. Normally, the nut will be tightened with a wrench in order to securely hold the propeller in place on the submersible column 12**.

In a similar manner, the stop device 32 acts to prevent propeller 14 from rotating in a counterclockwise direction when the prop nut 22 is loosened. In this case, one of the blades 18 engages the other side wall **36*b* of leg 36 in order to prevent counterclockwise rotation of the propeller beyond the position at which the blade moves into engagement with the leg 36. Consequently, the prop nut 22** can be easily loosened with a wrench or other tool.

It is preferred that the device 32 fit rather closely on the tail plate 26 so that the device has at best only minimal side-to-side play when it is mounted in place on the fin structure of the engine. After the prop nut has been tightened or loosened, the device 32 can simply be slid off of the tail plate 26 so as not to interfere with normal operation of the propeller. The device can be used again on the same or another outboard engine when necessary.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A propeller stop device for application to an outboard marine engine which includes a submersible column having a projecting fin structure and a rotary propeller beneath said fin structure having spaced apart blades and a retaining nut for holding the propeller on the column, said device comprising a rigid stop member for retaining the propeller against rotation and means for detachably securing said stop member to the column at a location to extend between adjacent blades and to serve as a stop acting against one of the blades in a manner to hold the propeller against rotation while the retaining nut is being tightened and loosened, said detachable securing means including a hollow body having a size and shape to fit on the fin structure to removably secure said body thereon, said stop member extending from said body at a location to engage the propeller blades when the body is fitted on the fin structure.

2. The invention of claim 1, wherein:

the fin structure includes a generally horizontal tail plate and a generally vertical fin on the underside of the tail plate;

said body includes a pair of hollow wings which fit removably on the tail plate; and said stop member comprises a leg projecting downwardly from said body at a location between said wings, said leg having a slot therein for receiving the fin when the wings are fitted on the tail plate.

3. The invention of claim 2, wherein each wing presents a slot closely receiving the tail plate when said body is applied thereto.

4. The invention of claim 3, wherein:

the fin structure includes a second fin on the top side of the tail plate; and said body has a notch therein for receiving the second fin when said wings are fitted on the tail plate.

5. The invention of claim 4, wherein said notch is located generally between said wings and is tapered.

6. A propeller stop device for application to an outboard marine engine having a submersible column, a fin structure on the column, a rotary propeller beneath the fin structure having a plurality of blades, and a retaining nut for holding the propeller on the column, said device comprising:

a body having a size and shape to detachably fit on the fin structure, said body being held rigidly in place on the fin structure when fitted thereon; and a stop member projecting from said body at a location to extend between adjacent blades of the propeller when said body is fitted on the fin structure, said stop member acting against the propeller blades to serve as a stop retaining the propeller against rotation while the retaining nut is being tightened and loosened.

7. The invention of claim 6, wherein the fin structure includes a generally horizontal tail plate and said body includes a pair of wings on opposite sides thereof for application to the tail plate, each wing having a slot therein closely receiving the tail plate when said body is fitted on the fin structure.

8. The invention of claim 7, wherein the fin structure includes a generally vertical fin on the tail plate, said body presenting a notch between said wings for receiving the fin when said body is fitted on the fin structure.

9. The invention of claim 8, wherein the fin structure includes a second generally vertical fin on the underside of the tail plate and said stop member comprises a leg projecting from said body at a location between said wings, said leg having a slot therein for receiving the second fin when said body is fitted on the fin structure.

10. The invention of claim 8, wherein said notch is tapered.

11. The invention of claim 7, wherein the fin structure includes a generally vertical fin on the underside of the tail plate and said stop member comprises a leg projecting from said body at a location between said wings, said leg having a slot therein for receiving the fin when said body is fitted on the fin structure.

12. A propeller stop device for application to an outboard marine engine having a submersible column, a generally horizontal tail plate on the column, a generally vertical fin on the tail plate, a rotary propeller having a plurality of blades, and a retaining nut for holding the propeller on the column at a location beneath the tail plate, said device comprising a generally T-shaped body having a pair of hollow wings on opposite sides thereof and a leg between said wings, said wings fitting closely on the tail plate to detachably secure said body thereto with said leg projecting between adjacent blades of the propeller, said leg being hollow to receive the fin therein when said body is secured on the tail plate and said leg being engageable with the propeller blades to rigidly hold the propeller against rotation while the retaining nut is being applied to and removed from the propeller.

13. The invention of claim 12, wherein the fin extends above the tail plate and said body presents a notch between said wings to receive the fin when said body is secured on the tail plate.

14. The invention of claim 13, wherein said notch is tapered.

* * * * *